United States Patent [19]

Brandt

[11] Patent Number: 4,529,387

[45] Date of Patent: Jul. 16, 1985

[54] PROPELLER DRIVE UNIT FOR BOATS

[75] Inventor: Lennart H. Brandt, Fjärås, Sweden

[73] Assignee: AB Volvo Penta, Gothenburg, Sweden

[21] Appl. No.: 531,614

[22] Filed: Sep. 12, 1983

[30] Foreign Application Priority Data

Sep. 13, 1982 [SE] Sweden ..... 8205216

[51] Int. Cl.[3] ..... B63H 5/10

[52] U.S. Cl. ..... 440/66; 416/129; 440/80

[58] Field of Search ..... 440/51, 76, 78, 79, 440/80, 81, 89, 66; 416/128, 129

[56] References Cited

U.S. PATENT DOCUMENTS

| | | | |
|---|---|---|---|
| 2,064,195 | 12/1936 | Michelis | 440/81 |
| 2,672,115 | 3/1954 | Conover | 440/80 |
| 2,681,029 | 6/1954 | Canazzi | 115/35 |
| 2,739,561 | 3/1956 | Kiekhaefer | 440/60 X |
| 3,250,501 | 5/1966 | Alexander, Jr. | 440/76 X |
| 3,256,853 | 6/1966 | Warburton, II | 115/35 |
| 3,537,419 | 11/1970 | Holtermann et al. | 440/89 X |
| 4,074,652 | 2/1978 | Jackson | 115/35 |
| 4,178,873 | 12/1979 | Bankstahl | 440/89 |
| 4,352,666 | 10/1982 | McGowan | 440/51 X |

FOREIGN PATENT DOCUMENTS

| | | |
|---|---|---|
| 199969 | 11/1965 | Sweden . |
| 403083 | 7/1978 | Sweden . |

*Primary Examiner*—Sherman D. Basinger

*Attorney, Agent, or Firm*—Arthur G. Yeager

[57] ABSTRACT

A double propeller drive unit for boats having an inclined steering axis and a trim fin arrangement which is fixed to the cavitation plate of the drive unit, is disposed in the boundary region between the propellers, and is designed to balance torques acting on the drive unit.

6 Claims, 3 Drawing Figures

PROPELLER DRIVE UNIT FOR BOATS

The present invention relates to a propeller drive unit for boats, comprising a pair of concentric propeller shafts counterrotationally driven in a drive housing, each of said propeller shafts carrying an individual propeller, said drive housing being pivotable about a steering axis which forms an obtuse angle with the propeller shaft and haing an anticavitation plate disposed above the propellers.

When driving straight ahead with a planing boat equipped with an inboard engine and an outboard drive unit, a so-called inboard-outboard, the driver experiences certain steering wheel forces, which are caused by the fact that the engine torque and the reaction torque from the water on the propeller have components which, with an inclined steering axis, strive to turn the drive unit, at the same time as flow forces on the drive unit and propeller produce transverse forces which also strive to turn the drive unit about its steering axis. The sum of the various steering torques produces a resultant torque which must be counter-balanced in order to achieve neutral steering within at least a specific speed range.

The reaction torque from the water on the propeller is directed differently depending on whether the propeller rotates counter-clockwise or clockwise. Thus, in a single propeller drive unit, the rotational direction of the propeller can be selected so that the reaction torque counteracts the engine torque. The resulting steering torque can be counter-balanced in a wellknown manner with the aid of a small trim fin arranged behind the propeller.

In double propeller drive units with counterrotational propellers, this same possibility is not available to produce a reaction torque counteracting the engine torque, since there is, in principle, torsional balance between the propellers, i.e. the reaction torques essentially equalize each other. Furthermore, in double propeller drives with the forward propeller rotating counter-clockwise and the rear propeller rotating clockwise (an advantageous combination in some respects), the steering torque increases somewhat when the drive is trimmed out. This increase is more pronounced than for a counter-clockwise rotating single propeller due to the fact that there is no appreciable cavitation in the double propeller combination.

The purpose of the present invention is to achieve a propeller drive unit of the type described in the introduction, in which the steering torques, despite the special conditions described above, can be reduced effectively even when the drive unit is trimmed out.

This is achieved according to the invention by providing the anticavitation plate on its underside with a trim fin arrangement disposed in the boundary region between the propellers. In this region, the forward propeller "blows" at the same time as the rear propeller "sucks", which means that a well defined velocity field flows continuously around the trim fin regardless of the trim angle of the drive unit.

For various reasons, e.g. to keep the steering forces under control during sharp turns or exceptional trim angles, it is desirable to keep a relatively small spacing between the propellers, which however results in a limitation of the available side surface for the trim fin arrangement. If the fin is quite small, it must work with large angles and arches with subsequent high loads, which makes the fin ineffective. In a further development of the drive unit according to the invention, the trim fin arrangement is therefore made with at least two parallel fins or wings. This provides a sufficiently large surface within a limited region at the same time as the gap effect through the interaction of the wings contributes to increasing the total effectiveness.

The invention will be described in more detail below with reference to an example shown in the accompanying drawings.

Figure 1:
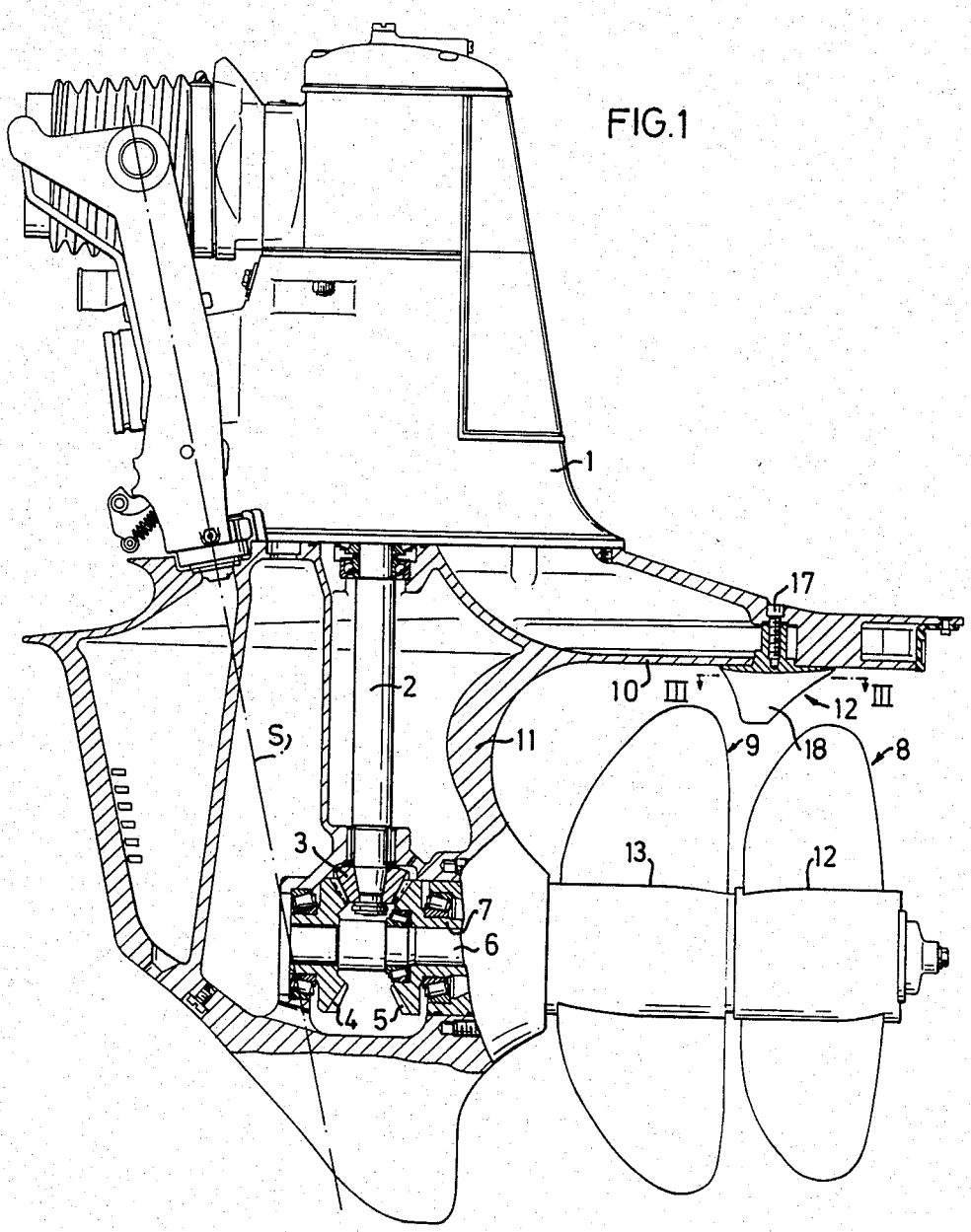
FIG. 1 shows a side view in partial section of a double propeller drive unit according to the invention.
Figure 2:
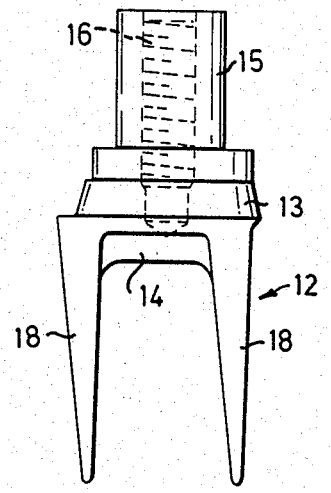
FIG. 2 shows a front view of the trim fin arrangement in FIG. 1.

The propeller drive unit shown in FIG. 1 is a so-called inboard-outboard drive unit designed to be mounted on the transom of a boat and connected to the outboard shaft of an engine (not shown). The drive unit comprises a housing 1 and contains a reversing mechanism with an outboard shaft 2, which has a conical gear 3 in constant engagement with two conical gears 4 and 5. The gear 4 drives a propeller shaft 6 and the gear 5 drives a hollow propeller shaft 7 concentrically mounted with the shaft 6. The shaft 6 carries a propeller 8 and the shaft 7 carries a propeller 9. In the embodiment described, the propeller shafts will rotate in opposite directions, with the rotational direction of the shaft 2 being selected so that the shaft 7 rotates counter-clockwise as seen from the rear.

The drive housing 1 is pivotable about an inclined steering axis S, which, in a conventional manner, intersects the drive joint (not shown) between the engine and drive. The mounting of the drive unit and the steering mechanism are conventional and are not described in more detail here. The inclination of the steering axis S in drive units of this type is dependent on the fact that it must intersect the universal joint between the engine and the drive and also pass relatively close to the pressure center for the underwater housing of the drive unit. The angle of the steering axis S to the engine drive shaft and the rotational axis of the propellers determines the size of the steering torques acting on the drive unit stemming from the engine torque and the reaction torque from the water on the propellers. Common values of this angle are 102°–105°. When the drive is trimmed out, the angle to the engine drive shaft increases, thus increasing the steering torque on the drive unit from the engine torque.

The drive housing is made in a known manner with an anticavitation plate 10, which projects aft over the propellers. The portion of the drive housing situated below the anticavitation plate is the underwater housing 11 of the drive unit. To balance the resultant steering torque acting on the drive unit to achieve essentially neutral steering within at least a certain speed range, the anticavitation plate 11 has a trim fin arrangement (generally designated 12) which the water flowing past it loads with a transverse force directed so as to produce a compensating steering torque.

Figure 3:
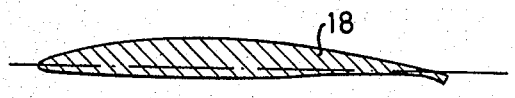
FIG. 3 shows a section along the line III—III in FIG. 1.

The trim fin arrangement 12 has an essentially rectangular bottom plate 13 with an arched downwardly directed surface 14. A cylinder 15 with a central threaded bore 16 extends upwards from the upper surface of the plate 13. The cylinder 15 projects into an opening in the cavitation plate 10 and is kept in place by a screw 17. The bottom plate 13 is made with a pair of vertical parallel fins or wings 18, which are disposed in the boundary region between the propellers. As can be seen in FIG. 3, the fins 18 are asymmetrical (wing-profile-shaped) to provide a transverse force (lift) with a minimum of flow resistance. Furthermore, the tail edge is cupped to reduce the susceptibility of the fin to cavitation and to prevent sudden slippage during oblique flow. As viewed from the side, the shapes of the front and rear edges of the wings conform essentially to the rear edge of the front propeller blade and the front edge of the rear propeller blade, respectively, as can be seen in FIG. 1. Tests have shown that the distance between the propellers 8, 9 and the edges of the fins 18 should not be less than 10 mm. The spacing between the fins 18 is, as can be seen in the Figures, essentially less than their length and height. In the drive unit shown in FIG. 1, which is designed for diesel engines with power ratings of about 150–300 HP and for speeds exceeding 25 knots, a distance of about 25 mm between the tips of the fins has proved to be suitable.

In the preceding, the invention has been described with reference to an inboard-outboard drive unit designed to be mounted on a transom, but it can of course also be applied to drive units, in which the drive housing is designed to be mounted projecting through an opening in the bottom of a boat, a so-called S-drive.

What I claim is:

1. In a propeller drive unit for boats, the improvement comprising a drive housing, a pair of concentric propeller shafts, means for mounting said shafts to said housing and being driven counter-rotationally with respect to each other, each of said propeller shafts carrying an individual propeller, means for pivoting said drive housing about a steering axis which forms an obtuse angle with said propeller shafts, an anti-cavitation plate connected to said drive housing and disposed above said propellers, a trim fin assembly disposed in the boundary region defined between said propellers depending from and attached to said anti-cavitation plate and terminating closely adjacent both of said propellers.

2. In the propeller drive unit according to claim 1 wherein said trim fin assembly includes at least two spaced and substantially parallel fins.

3. In the propeller drive unit according to claim 2 wherein each of said fins is in the form of an asymmetrical, wing-shaped cross-sectional profile.

4. In the propeller drive unit according to claim 3 wherein the distance between said fins is less than the height of said fins.

5. In the propeller drive unit according to claim 2 wherein the distance between said fins is less than the height of said fins.

6. In the propeller drive unit accord to claim 2 wherein each of said fins includes a rearward edge having a cupped shape to minimize cavitation and inhibit slippage during oblique water flow.

* * * * *